US011708658B2

(12) United States Patent
Tütek

(10) Patent No.: US 11,708,658 B2
(45) Date of Patent: Jul. 25, 2023

(54) SELF-ADJUSTING LOCK SYSTEM

(71) Applicant: SERDAR PLASTIK SANAYI VE TICARET ANONIM ŞIRKETI, Sincan/Ankara (TR)

(72) Inventor: Serdar Mustafa Tütek, Sincan/Ankara (TR)

(73) Assignee: SERDAR PLASTIK SANAYI VE TICARET ANONIM SIRKETI, Sincan/Ankara (TR)

( * ) Notice: Subject to any disclaimer, the term of this patent is extended or adjusted under 35 U.S.C. 154(b) by 322 days.

(21) Appl. No.: 16/618,155

(22) PCT Filed: May 17, 2018

(86) PCT No.: PCT/TR2018/000047
§ 371 (c)(1),
(2) Date: Nov. 28, 2019

(87) PCT Pub. No.: WO2018/231181
PCT Pub. Date: Dec. 20, 2018

(65) Prior Publication Data

US 2020/0087957 A1 Mar. 19, 2020

(30) Foreign Application Priority Data

May 30, 2017 (TR) ..... 2017/07943

(51) Int. Cl.
*D06F 39/14* (2006.01)
*E05B 15/04* (2006.01)
(Continued)

(52) U.S. Cl.
CPC ..... *D06F 39/14* (2013.01); *E05B 15/04* (2013.01); *E05C 3/12* (2013.01);
(Continued)

(58) Field of Classification Search
CPC ..... A47L 15/4259; D06F 39/14; D06F 37/42; D06F 2105/44; E05B 15/04; E05B 15/101; E05B 2015/0235; E05B 2015/0406; E05B 2015/0437; E05B 17/0025; E05B 2047/0068; E05C 3/00; E05C 3/002; E05C 3/004; E05C 3/006; E05C 3/008;
(Continued)

(56) References Cited

U.S. PATENT DOCUMENTS 3,387,873 A * 6/1968 Prosser ..... A47L 15/4259 292/175
4,351,288 A * 9/1982 Gasloli ..... F24C 15/022 126/192
(Continued)

FOREIGN PATENT DOCUMENTS

WO WO-2013124873 A2 * 8/2013 ..... E05B 47/0603

*Primary Examiner* — Kristina R Fulton
*Assistant Examiner* — Noah Horowitz

(57) ABSTRACT

The present invention is a lock system that can be used in the entire sector of white appliances and characterized by comprising a lock bolt (4) that fits into its seat through the stretching of the lock bolt housing (6) by means of the spring (3) located on the body (1) and a mechanism that allows the machine hatch to be closed by restoring the lock bolt housing (2) back to its former position even if the lock bolt housing (2) is in closed position.

2 Claims, 4 Drawing Sheets

Figure 1:
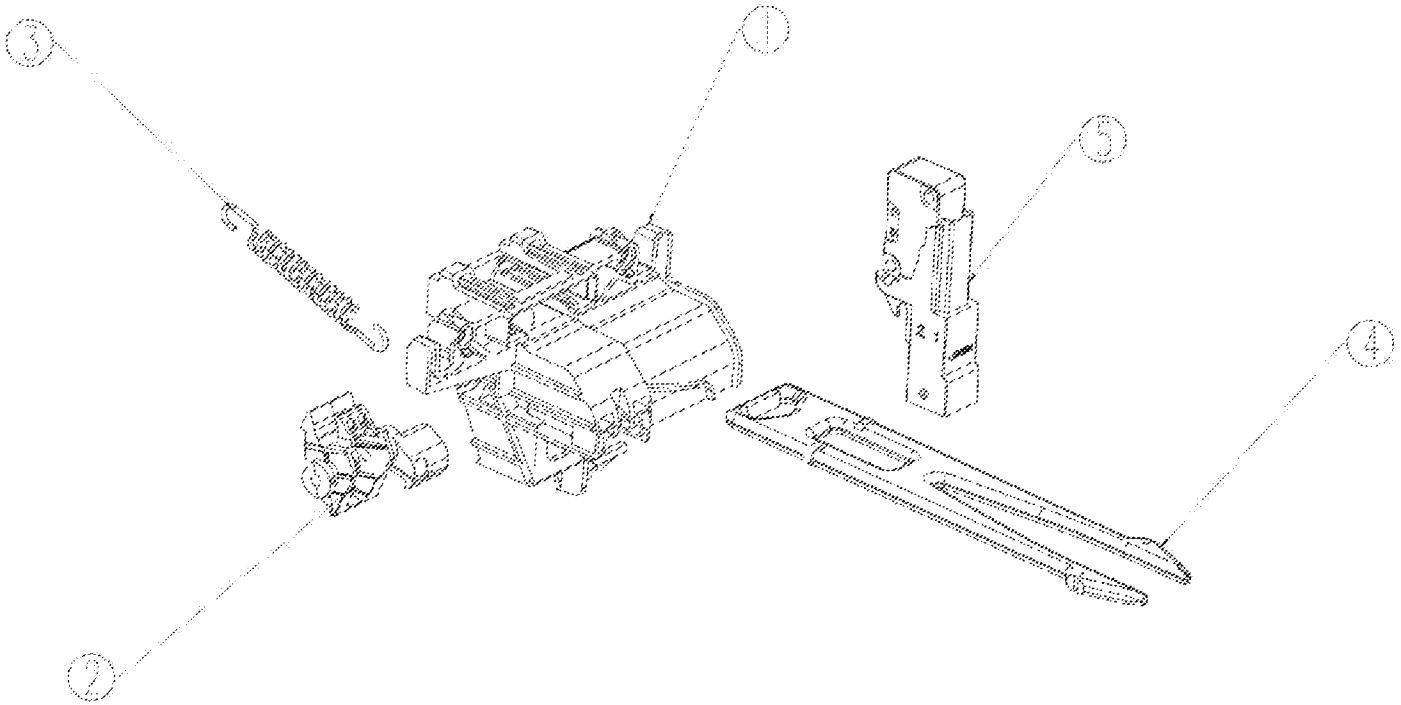

(51) Int. Cl.
*E05C 3/12* (2006.01)
*E05B 15/02* (2006.01)
*E05B 47/00* (2006.01)

(52) U.S. Cl.
CPC ..... *E05B 2015/0235* (2013.01); *E05B 2015/0406* (2013.01); *E05B 2015/0437* (2013.01); *E05B 2047/0068* (2013.01)

(58) Field of Classification Search
CPC ..... E05C 3/12; E05C 3/16; E05C 3/22; E05C 3/24; E05C 3/26; E05C 3/30; E05C 3/38; E05C 3/40; E05C 2005/005; Y10T 292/0886; Y10T 292/0887; Y10T 292/0891; Y10T 292/0893; Y10T 292/0913; Y10T 292/0918; Y10T 292/0934; Y10T 292/0948; Y10T 292/0951; Y10T 292/0952; Y10T 292/0953; Y10T 292/0959; Y10T 292/1078; Y10S 292/69
See application file for complete search history.

(56) References Cited

U.S. PATENT DOCUMENTS 6,913,296 B2 * 7/2005 Bassi ..... A47L 15/4259 292/122
8,276,951 B2 * 10/2012 Dirnberger ..... D06F 37/42 292/336
10,258,219 B2 * 4/2019 Ayaroglu ..... D06F 29/005
11,015,371 B2 * 5/2021 Schmidt ..... E05B 17/0025

* cited by examiner

SELF-ADJUSTING LOCK SYSTEM

The present invention relates to a self-adjusting locking system usable in all types of white appliances such as dishwashers and washing machines that utilize hatch locking mechanisms which allows the user to shut the machine hatch even though the lock bolt's housing is closed.

TECHNICAL FIELD OF THE INVENTION

The present invention relates to locking systems used in all types of white appliances.

Problems that the Invention Seeks to Solve

Due to an unknown reason, following the switching of lock bolts in locking mechanisms to a closed position while the hatch is open, hatches of dishwashers or suchlike devices cannot be closed and when the hatch is forced to shut by the end user housing of the lock bolt breaks. In both of these cases end users end up calling technical service personnel.

State of the Art

In all of the manufactured white appliances, locking mechanisms are mounted on the hatch. The hatch gets locked once the lock bolt mounted on the machine's hatch slips into the lock bolt housing located on the lock's body and teeth on the lock bolt housing goes into the gap located on the lock bolt when the machine's hatch is closed. After the switch locking operation on the lock's body is carried out, the machine receives a signal and the operation commences. While the hatch is open, lock bolt housing located on the hatch could switch into a closed position due to an unknown reason. Because of this particular unknown reason, when the end user tries to shut the hatch lock bolt does not go into the lock bolt's housing.

The present invention, against locking issues seen in locking systems used in white appliances and hatch shutting problems occurring due to an unknown reason when the lock bolt housing located on the hatch's locking mechanism relates to a self-adjusting locking system that allows hatches to be shut no matter what position the lock bolt is in.

Gliding channel located on the locking mechanism body on which the lock bolt housing is mounted, pushes the teeth of the lock bolt housing which is in a closed position while the lock bolt is going into the said housing once the lock bolt housing is closed.

BRIEF DESCRIPTION OF THE INVENTION

The present invention relates to a self-adjusting locking system that converts a horizontal motion into a vertical motion in the lock bolt housing (2) inside the gliding channel located on the lock body (1) by using the available spring (3) of the lock group without rotating the lock bolt housing (2) on the lock body (1) which occurs during the collision action of the lock bolt (4) when hatch of the white appliance is closed.

FIGURES

1—Exploded View of the Self-Adjusting Lock System
2—Top View of the Self-Adjusting Lock System
3—Frontal Perspective View of the Self-Adjusting Lock System

4—Detailed View of the Gliding Channel included in the Self-Adjusting Lock System

LIST OF REFERENCES

5—Lock Body
6—Lock Bolt Housing
7—Spring
8—Lock Bolt
9—Hatch Safety Switch
10—Gliding Channel

DISCLOSURE OF THE INVENTION

Subject matter lock system is characterized by comprising lock body (1), gliding channels (6) located on the body, lock bolt housing (2), lock bolt (4), hatch safety switch (5) and spring (3).

Subject matter invention relates to a self-adjusting locking system that converts a horizontal motion into a vertical motion in the lock bolt housing (2) inside the gliding channel located on the lock body (1) by using the available spring (3) of the lock group without rotating the lock bolt housing (2) on the lock body (1) which occurs during the collision action of the lock bolt (4) when hatch of the white appliance is closed.

The present invention is a lock system that forms a group with hatch safety switch (5), lock bolt housing (2) and spring positioned on the lock body (1), When the hatch is opened the lock bolt (4) that locks the hatch, lock bolt housing (2) rotates on the housings located on the channeled lock body (1) and disengages from the lock bolt (4). In case the hatch is wanted to be shut in available systems when the lock bolt housing (2) switches to a closed position by an extraneous force while the hatch is open, because the lock bolt (2) is shut, locking system prevents the hatch from being closed.

FIG. 1 illustrates the exploded view of the self-adjusting lock system. Lock body (1) is located on the hatch and keeps lock bolt housing (2) and spring (3) mechanism atop and facilitates movement upon the gliding channels (6) located on the body (1).

Lock bolt housing (2) holds the teeth that goes into the lock bolt's (4) gap and mounted on the lock bolt's body (1). When the lock bolt (4) is forced to be shut lock bolt housing (2) allows the lock bolt (4) to be seated by pushing it downwards through the gliding channels (6) located on the body when the lock bolt housing is in closed position.

Spring (3) is positioned between the lock bolt housing (2) and lock bolt body (1). Spring (3) holds the lock bolt housing (2) on the lock body (1) under a certain amount of pressure. By this means it prevents the lock bolt housing (3) to close itself while the lock is open.

Lock bolt (4) is the part that is mounted on the machine's main frame and that allows the hatch to be locked. The teeth located on the lock bolt housing (2) goes into the gap at the end of the lock bolt (4) which allows the performing of the locking action.

Hatch safety switch (5) is mounted on the lock body (1). Once the hatch is closed it sends a signal to the machine which then initiates the operation of the system. When the hatch is open it deactivates the system automatically.

Figure 2:
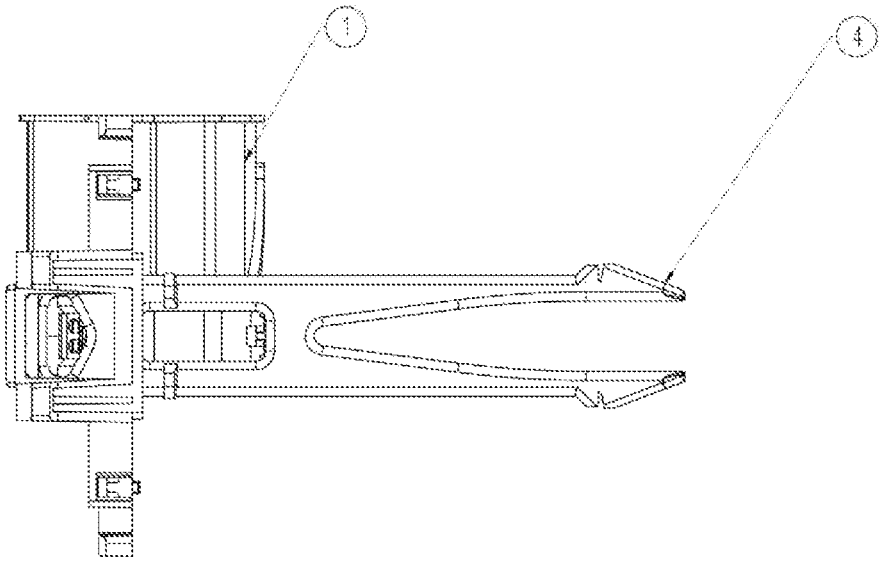

In FIG. 2 top view of the self-adjusting lock system is provided. It demonstrates the particular position when the lock bolt (4) goes into the lock bolt housing (2).

Figure 3:
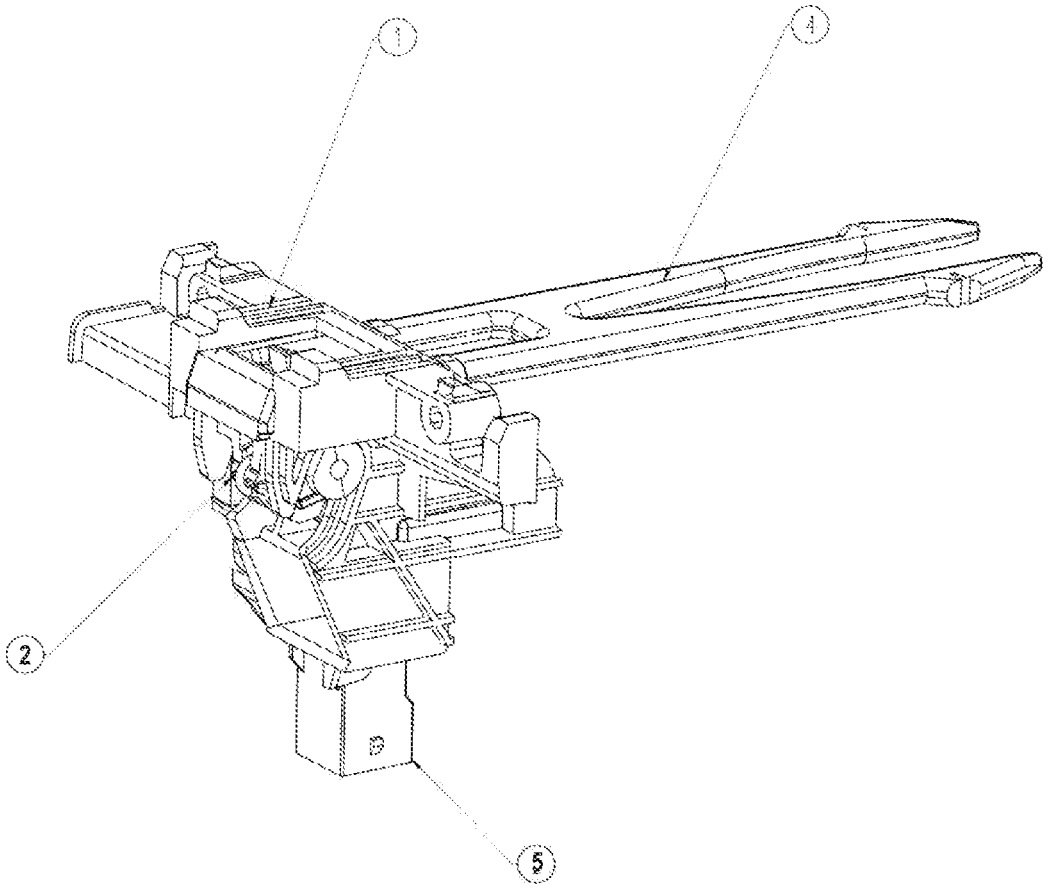

FIG. 3 shows the frontal perspective of the subject matter self-adjusting lock system. In this Figure position of the gliding channel (6) can be observed. Gliding channel (6) is located on the lock body (1) and below the lock bolt housing (2).

Figure 4:
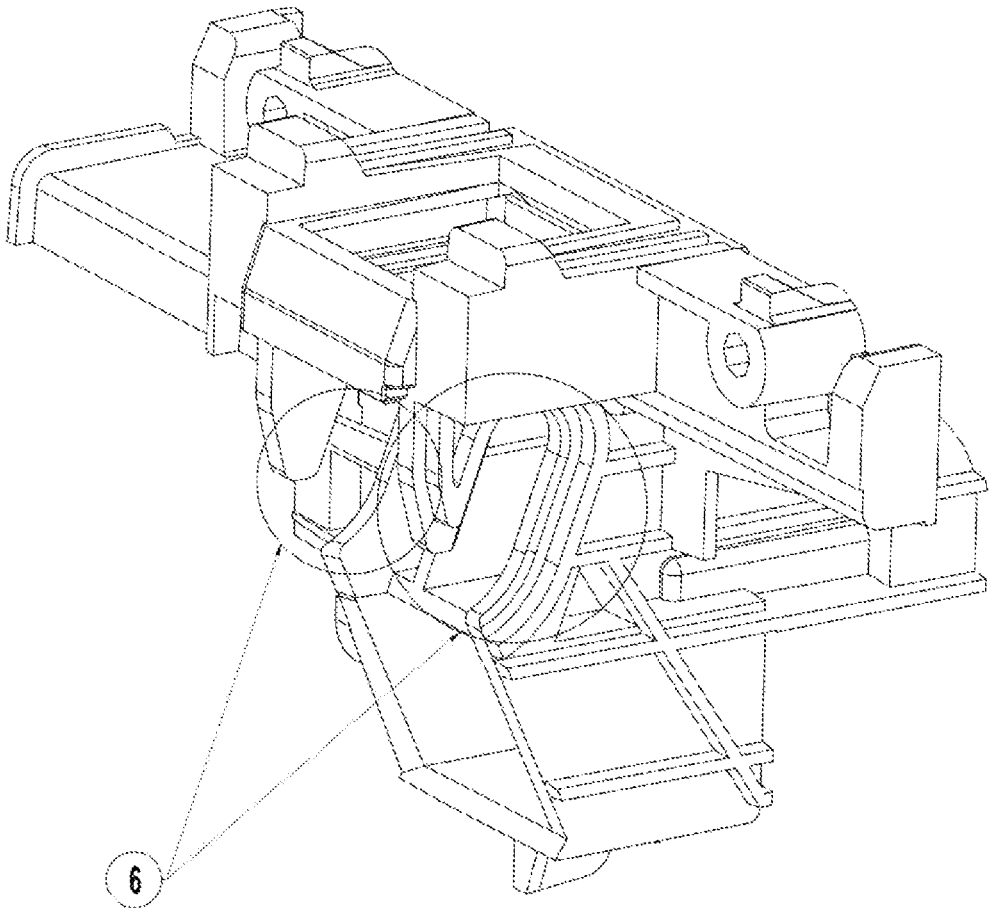

In FIG. 4 a detailed view of the gliding channel (6) is provided. Gliding channel (6) located on the lock body (1) assumes an assistive role in locking of the lock bolt (4) by sliding downwards during the action of closing the hatch while the lock bolt housing (2) is closed. In the subject matter self-adjusting lock system, lock bolt housing (2) upon the gliding channels (6) located on the body moves the lock bolt (4) by stretching the lock bolt housing (2) allowing the lock bolt (4) to be fitted into the gap then it returns to its former position completing the locking action by means of the spring (3).

In the subject matter invention lock bolt housing (2) moves in gliding channels (6) located on the body (1) by means of the spring (3).

If the lock bolt housing (2) switched to closed position even if the hatch is open, lock bolt (4) moves the lock bolt housing (2) upon the lock body (1) allowing the lock bolt (4) to be fitted into its hole and completes the operation of the lock system by restoring the lock bolt housing (2) back to its former position.

On account of the present invention, lock bolt (4) stretches inside housings located on the lock body (1) even if the lock bolt housing (2) is closed allowing the lock bolt (4) to be fitted to the hatch.

What is claimed is:

1. A self-adjusting lock system for white appliances, the system comprising:

a lock bolt housing (2) comprising a first cylindrical guiding member and a second cylindrical guiding member, disposed on opposite sides of the lock bolt housing (2);

a body (1), wherein, the body (1) defines a first receiving portion configured to house the lock bolt housing (2);

the body (1) defines a second receiving portion;

the body (1) comprises a first and a second gliding channels (6), wherein each of the first and the second gliding channels (6) define a substantially curved passage, wherein the first cylindrical guiding member is received over the curved passage of the first gliding channel (6) and the second cylindrical guiding member is received over the curved passage of the second gliding channel (6), wherein at least a part of the first and the second cylindrical guiding members of the lock bolt housing (2) are configured to interface with the first and the second gliding channels (6); and a spring (3), wherein the spring (3) is positioned between the lock bolt housing (2) and the body (1);

a lock bolt (4) configured to be received by the second receiving portion in the body (1), wherein lateral traversing of the lock bolt (4) into the second receiving portion at:

a first position causes the first and the second cylindrical guiding members of the lock bolt housing (2) to glide over the curved passage of the first and the second gliding channels (6) in a downwards direction from a lock bolt housing first position towards a lock bolt housing second position against the force of the spring (3); and a second position causes the first and the second cylindrical guiding members of the lock bolt housing (2) to glide over the curved passage of the first and the second gliding channels (6) in an upwards direction from the lock bolt housing second position towards the lock bolt housing first position to securely couple the lock bolt (4) and the lock bolt housing (2), wherein the axis of lateral traversing of the lock bolt (4) is substantially perpendicular to the axis of direction of the upward and the downward gliding of the lock bolt housing (2); and a mechanism that enables a hatch of the white appliance to be closed by restoring the lock bolt housing (2) back to the lock bolt housing first position even if the lock bolt housing (2) is in the lock bolt housing first position.

2. The self-adjusting lock system as claimed in claim 1, wherein the lock bolt (4) traverses inside housings located on the body (1) allowing the lock bolt (4) to be received by the lock bolt housing (4) even though the lock bolt housing (4) is in the lock bolt housing first position.

* * * * *